US008322829B2

(12) United States Patent
Sakuma et al.

(10) Patent No.: US 8,322,829 B2
(45) Date of Patent: Dec. 4, 2012

(54) LIQUID DISCHARGE HEAD SUBSTRATE AND MANUFACTURING METHOD THEREOF, AND LIQUID DISCHARGE HEAD USING LIQUID DISCHARGE HEAD SUBSTRATE AND MANUFACTURING METHOD THEREOF

(75) Inventors: Sadayoshi Sakuma, Kawasaki (JP); Hirokazu Komuro, Yokohama (JP); Souta Takeuchi, Yokohama (JP); Takahiro Matsui, Yokohama (JP); Takuya Hatsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 227 days.

(21) Appl. No.: 12/834,738

(22) Filed: Jul. 12, 2010

(65) Prior Publication Data

US 2011/0012960 A1 Jan. 20, 2011

(30) Foreign Application Priority Data

Jul. 17, 2009 (JP) ..... 2009-168986
Sep. 10, 2009 (JP) ..... 2009-209540

(51) Int. Cl.
*B41J 2/045* (2006.01)

(52) U.S. Cl. ..... 347/68

(58) Field of Classification Search ..... 347/67–71
See application file for complete search history.

(56) References Cited

U.S. PATENT DOCUMENTS 7,196,458 B2 * 3/2007 Hiyoshi ..... 310/365
8,092,002 B2 * 1/2012 Ito ..... 347/94

FOREIGN PATENT DOCUMENTS

JP 2007-326240 12/2007

* cited by examiner

*Primary Examiner* — Lamson Nguyen
(74) *Attorney, Agent, or Firm* — Canon USA Inc IP Division

(57) ABSTRACT

A liquid discharge head substrate includes an electrode layer, which is electrically connected to an element that generates energy used for discharging a liquid and provided in an inner side of a region between a first face and a third face of a substrate, and a member made of resin which covers the electrode is provided in the region.

9 Claims, 13 Drawing Sheets

LIQUID DISCHARGE HEAD SUBSTRATE AND MANUFACTURING METHOD THEREOF, AND LIQUID DISCHARGE HEAD USING LIQUID DISCHARGE HEAD SUBSTRATE AND MANUFACTURING METHOD THEREOF

BACKGROUND OF THE INVENTION

1. Field of the Invention

The present invention relates to a liquid discharge head substrate used for recording information on a recording medium by discharging a liquid, a manufacturing method of the liquid discharge head substrate, a liquid discharge head using the liquid discharge head substrate, and a manufacturing method of the liquid discharge head.

2. Description of the Related Art

A liquid discharge head (also referred to as a head), which is formed by bonding a liquid discharge head substrate (also referred to as a head substrate) to a support substrate so that a liquid such as ink is discharged from a discharge port of the liquid discharge head, is mounted on a liquid discharge apparatus so that information can be recorded on a recording medium.

Japanese Patent Application Laid-Open No. 2007-326240 discusses a silicon head substrate having a through hole penetrating the silicon substrate and also having an electrode on a back side of the substrate. According to this configuration, a head substrate and a support substrate are electrically connected. The head discussed in Japanese Patent Application Laid-Open No. 2007-326240 is illustrated in FIG. 1. A recording element substrate H1100 having an electrode on the backside is electrically connected to a holding base H1200 via an electrode bump H1105.

The head substrate is formed by forming a plurality of head substrates at the same time on, for example, a silicon substrate and segmenting the substrates using a semiconductor manufacturing technique. Thus, if the size of each head substrate is large, the number of the head substrates yielded from one silicon substrate is decreased. As a result, the manufacturing cost will be increased. For this reason, there is a strong demand for smaller head substrates. Further, a small head substrate is also required from the viewpoint of miniaturization of a liquid discharge apparatus on which the liquid discharge head is mounted.

However, according to the head configuration discussed in Japanese Patent Application Laid-Open No. 2007-326240, a certain distance is necessary between an ink supply port and the electrode bump H1105 in preventing ink seepage. Further, the electrode bump H1105 is covered with a sealing compound H1317 that blocks the ink. If the distance is short, the possibility that an electrode is corroded due to the ink seepage is increased. Thus it has been difficult to reduce the area of the head substrate by reducing the distance.

SUMMARY OF THE INVENTION

The present invention is directed to providing a small-size liquid discharge head substrate useful in preventing ink seepage to an electrode.

According to an aspect of the present invention, the liquid discharge head substrate includes a substrate having a first face where a plurality of elements that generate energy are provided and a second face which includes a recessed portion and is on the other side of the first face, an electrode layer electrically connected to an element and provided on an inner side of the recessed portion, and a member made of resin provided in the recessed portion such that the member covers the electrode layer.

According to another aspect of the present invention, by providing the recessed portion in the head substrate and by sealing a gap between the recessed portion and a support substrate, even if the size of the head substrate is reduced, the distance between an electrode and a supply port is sufficient to prevent ink seepage to the electrode layer, and thus, a small liquid discharge head capable of preventing ink seepage to the electrode layer can be realized.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 2:
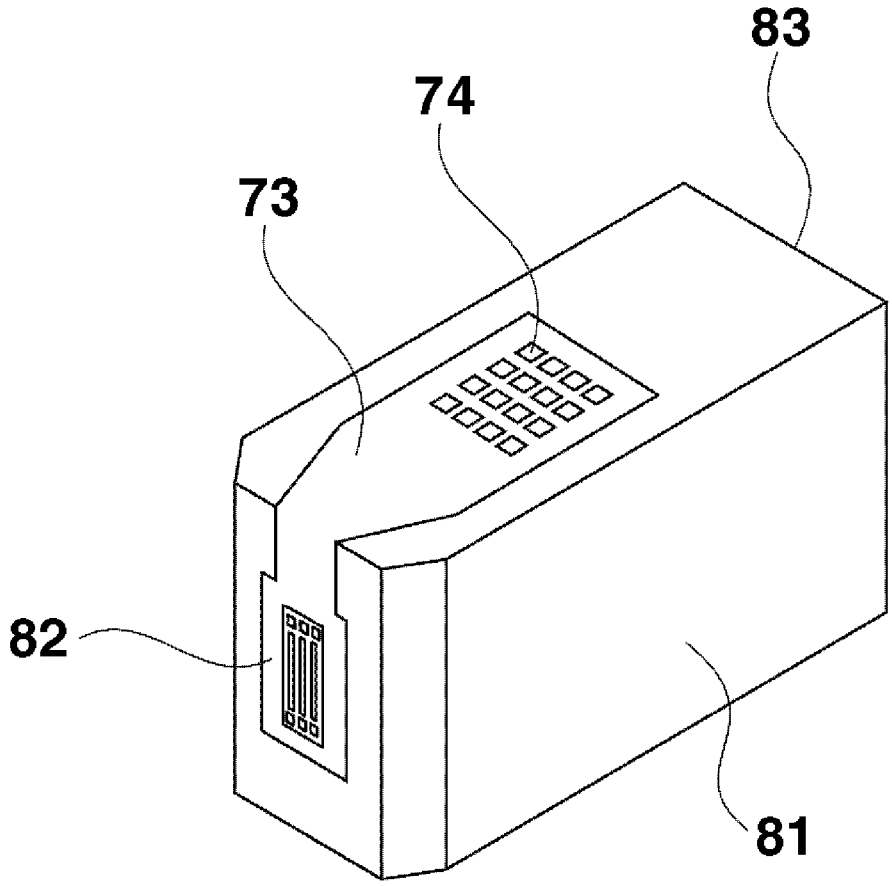
FIG. 2 is an example of a perspective view of a liquid discharge head according to the present invention.

FIG. 2 is a top view of a liquid discharge head (also referred to as a head) 83 according to the present invention. A liquid discharge head substrate 82 (also referred to as ahead substrate) is electrically connected to a contact pad 74 via a flexible film wiring substrate 73. A head 83 includes these components and an ink tank 81. The components are attached to the ink tank 81. The contact pad 74 connects the head 83 and a liquid discharge apparatus. Although the head 83 and an ink tank are integrated in FIG. 2, the head and the ink tank can be configured separately.

Figure 3A:
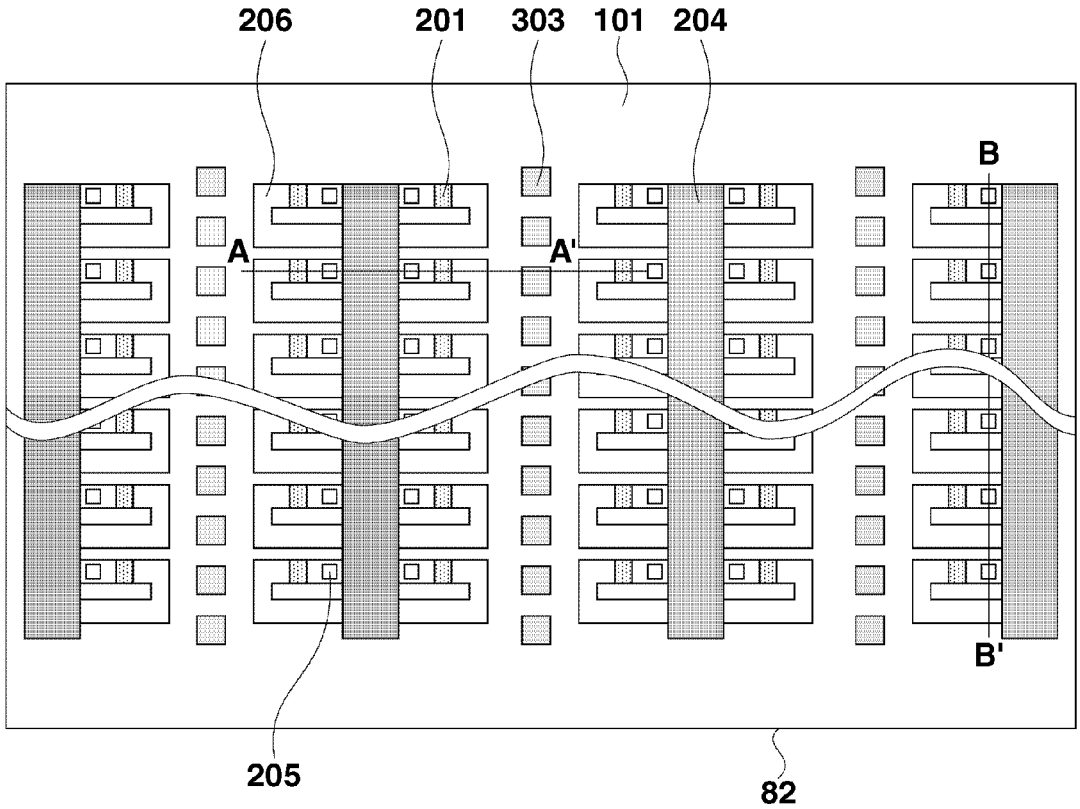
FIGS. 3A and 3B illustrate an example of a schematic top view of the head substrate according to the present invention.
Figure 3B:
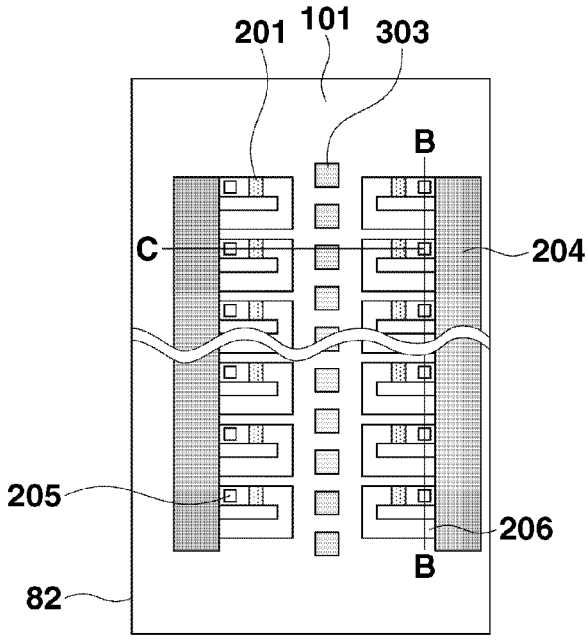

FIG. 3 is a schematic top view of the head substrate. FIG. 3A illustrates a head substrate 82 which is used for ahead using three rows of ink supply ports 303. Each row of the ink supply ports 303 discharges ink of a certain color (e.g., yellow, magenta, or cyan). Thus, three types of ink can be discharged from the supply ports. FIG. 3B illustrates a head substrate 82 which is used for a head including one row of the ink supply ports 303. One row of the supply ports discharges one type of ink.

The head substrate 82 illustrated in FIGS. 3A and 3B includes a heating element 201 and an individual power wiring 206. The heating element 201 is an energy generation element used for discharging ink. The individual power wiring 206, which is individually provided, supplies power to the heating element 201. Further, a row of elements is provided along one row of the supply ports, including a plurality of the supply ports 303, which supplies one type of ink. The row of the elements includes a plurality of heating elements 201 arranged on both sides of the row of the supply ports. A drive circuit portion 204 is provided along the row of the heating elements 201 on the opposite side of the row of the supply ports. The drive circuit portion 204 outputs a signal used for controlling drive of each of the heating elements 201.

Figure 4A:
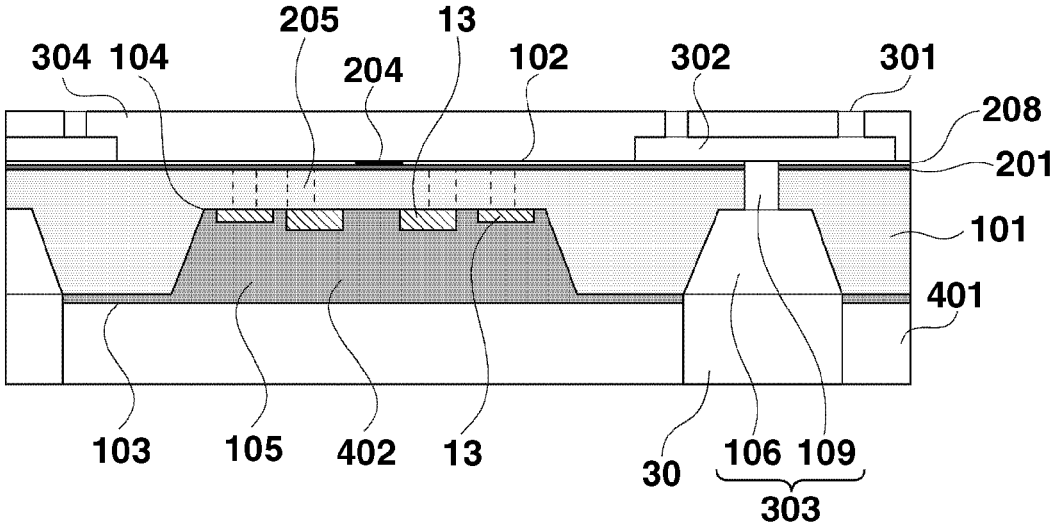
FIGS. 4A to 4C illustrate an example of a cross-sectional view of the head substrate illustrated in FIG. 3 taken along lines A-A' and C-C'.

FIG. 4A is an example of a cross section of the head substrate illustrated in FIG. 3A taken along a line A-A'. The heating element 201 is provided on a first face 102 of a substrate 101 made of silicon. A protecting layer 208, which protects the heating element 201 from ink, is provided on the heating element 201. A discharge port member 304 which configures a discharge port 301 and a flow path 302 of the ink is provided on the protecting layer 208. The discharge port 301 is provided at a position corresponding to the heating element 201. A flow path 302 communicates with the discharge port 301. The substrate 101 includes a plurality of supply ports 303. Each of the supply ports 303 communicates with the flow path 302. Each of the supply ports penetrates the substrate 101 and supplies ink which is discharged from the discharge port 301.

The substrate 101 includes a recessed portion which is formed so that a third face 104 is formed and exposed in addition to the first face 102 and a second face 103. The second face 103 is the other side of the first face 102. A support substrate 401 supports the head substrate 82. A portion between the third face 104 and the support substrate 401 when the head substrate 82 is mounted on the support substrate 401 is a first recessed portion 105. An electrode layer 202 and an electrode layer 203 are provided on the inner side of the first recessed portion 105. The electrode layers 202 and 203 are electrically connected to two rows of the elements provided between two adjacent rows of the supply ports. The electrode layer 202 is used for common GNDH wiring. The electrode layer 203 is used for common VH wiring.

A through-hole electrode 205 is provided in the substrate 101. The through-hole electrode 205 penetrates the substrate 101 from the first face 102 to the third face 104. The through hole of the through-hole electrode 205 is filled with a conductive material. The electrode layer 202 and the electrode layer 203 are connected to the through-hole electrodes 205 via a power wiring 13. Since the through-hole electrode 205 is connected to the individual power wiring 206, which is individually provided for each of the heating elements 201, a plurality of the heating elements 201, and the common electrode layers 202 and 203 are electrically connected to one another.

The electrode layers 202 and 203 are connected to a connection terminal 207 provided on the head substrate. The electrode layers 202 and 203 are electrically connected to the support substrate 401 which supports the head substrate via the connection terminal 207. The electrode layer 202 also serves as a ground wiring of the drive circuit. The electrode layer 202 is desirably low in resistance. By decreasing the resistance of the ground wiring, the potential difference between the source and the gate of the drive circuit including a driver such as a metal oxide semiconductor field-effect transistor (MOSFET) can be increased, and the drive power of the FET can be increased. The resistance of the electrode layer can be controlled by controlling the thickness of the electrode layer 202 and the electrode layer 203.

Further, either the electrode layer 202 used for GNDH wiring or the electrode layer 203 used for VH wiring and connected to the heating element 201 provided on both sides of the first recessed portion 105 can be provided in the first recessed portion 105. By only arranging either of the electrode layers within the first recessed portion 105, the number of the head substrates produced from one wafer can be increased.

Figure 4B:
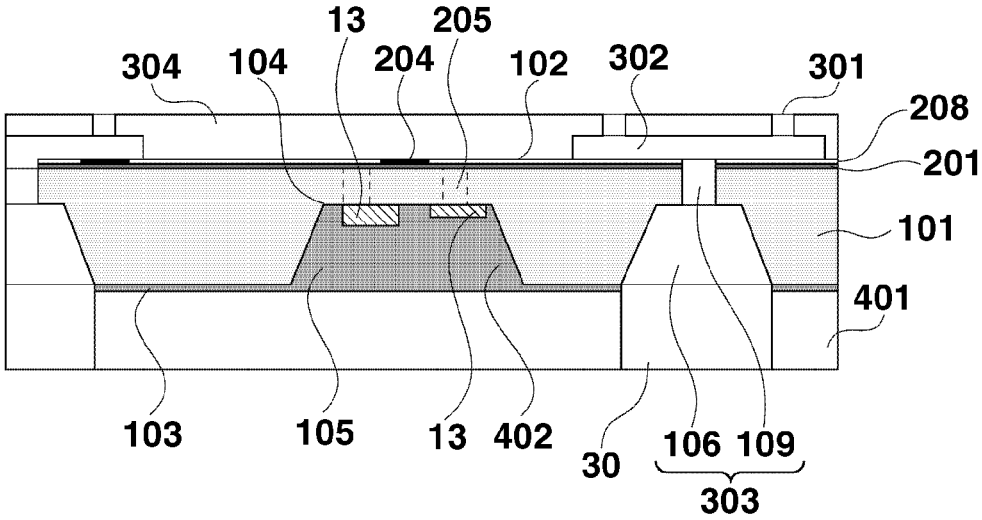

Further, as illustrated in FIG. 4B, a common electrode layer can be provided to electrically connect the two rows of the elements provided on both sides of the first recessed portion 105. In other words, the heating element 201 of a first row of the elements provided along a first row of the supply ports and the heating element 201 of a second row of the elements provided along a second row of the supply ports adjacent to the first row of the supply ports can be commonly connected to the electrode layers 202 and 203 in the first recessed portion 105. By reducing the number of the electrode layers 202 and 203 in the first recessed portion 105, the area necessary for the first recessed portion 105 can be reduced, and further, the cost is reduced.

Figure 4C:
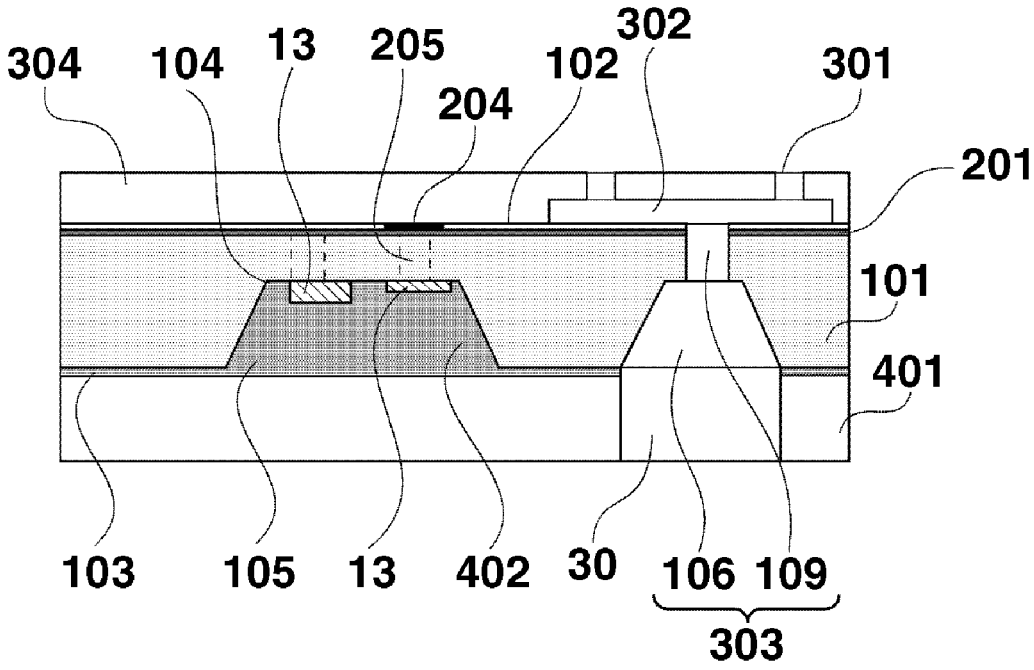

FIG. 4C is a cross section of the head substrate illustrated in FIG. 3B taken along a line C-C. The head substrate illustrated in FIG. 3B includes one row of a plurality of the supply ports 303 supplying one type of ink. The row of the elements is provided along and on both sides of the row of the supply ports. The electrode layers electrically connected to the row of the elements are arranged in the first recessed portion 105 provided along and on both sides of the row of the supply ports. Both or either of the electrode layer 202 and the electrode layer 203 can be arranged in the above-described first recessed portion 105.

A member 402, which is made of resin, is provided in the first recessed portion 105 where both or either of the electrode layer 202 and the electrode layer 203 is provided. By covering the entire third face with the member 402 where the electrode layer 202 and the electrode layer 203 are provided, the electrode layer 202 and the electrode layer 203 can be protected from ink. Further, by filling the first recessed portion 105 with the member 402, the first recessed portion 105 filled with the member 402 and the second face 103 of the substrate 101 can be planarized.

The head substrate is mounted on the support substrate 401 by bonding the mounting face of the head substrate and the connection face of the support substrate 401. The mounting face is the other side of the face where the discharge port 301 is provided. The mounting face of the head substrate and the connection face of the support substrate 401 are bonded by the member 402 which is the resin used in filling the first recessed portion 105. When the mounting face of the head substrate and the connection face of the support substrate 401 are bonded, they are bonded such that a position of an opening 30 of the support substrate matches a position of the supply port 303 of the head substrate 82.

Since the face of the first recessed portion 105 of the head substrate is planarized with the second face 103 and the head substrate is bonded with the support substrate 401, the head substrate can be mounted on the support substrate 401 while the mount face of the head substrate is in parallel with the connection face of the support substrate 401. Accordingly, the ink can be discharged from the discharge port in a desired direction. Thus, desired printing with respect to the printing position can be performed.

Further, by sealing the first recessed portion 105 using the member 402 made of resin, and by bonding the second face 103 and the support substrate 401 together, the distance between the row of the supply ports and the electrode layers 202 and 203 can be increased without increasing the area of the substrate area. According to this configuration, since the corrosion of the electrode layer which occurs when the ink flows on the surface between the support substrate 401 and the substrate 101 can be prevented, a high-reliability head substrate with reduced substrate area can be obtained.

Next, according to a first exemplary embodiment, an electrode layer connected to one row of the elements provided between two rows of the supply ports adjacent to each other, and an electrode layer connected to the other row of the elements illustrated in FIG. 4B which are used as common electrode layers, will be described in detail.

Figure 1:
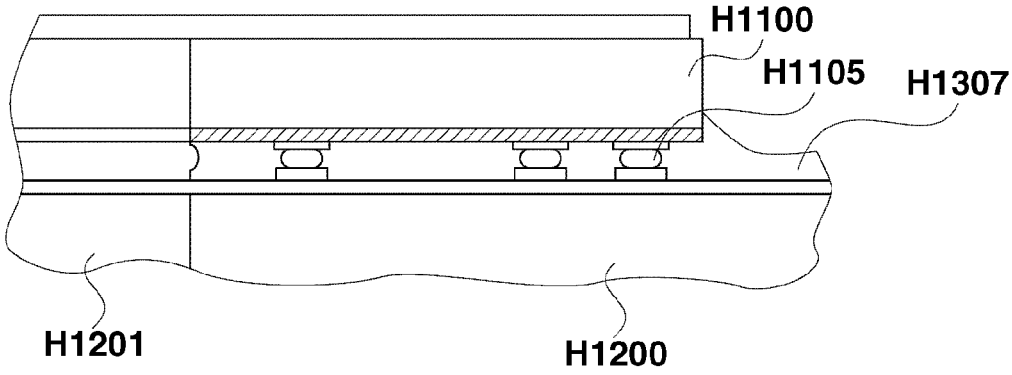
FIG. 1 is a cross sectional drawing of a conventional head substrate.

The liquid discharge head substrate illustrated in FIG. 4B includes a plurality of rows of the supply ports 303. On both sides of the row of the supply ports, as illustrated in FIG. 1, two rows of the heating elements 201 are symmetrically arranged across the row of the supply ports. The two adjacent rows of the supply ports are the first row of the supply ports and the second row of the supply ports.

In between the first and the second rows of the supply ports, the substrate 101 includes a plurality of the heating elements 201 which belong to the first row of the elements provided along the first row of the supply ports as well as a plurality of the heating elements 201 which belong to the second row of the elements provided along the second row of the supply ports. Further, a single first recessed portion 105 is provided between the first and the second rows of the supply ports. The heating element 201 of the first row of the elements and the heating element 201 of the second row of the elements provided along the second row of the supply ports are commonly connected to the electrode layers 202 and 203 provided in the first recessed portion 105 via the through-hole electrodes 205.

Next, a manufacturing process of the liquid discharge head substrate will be described referring to FIGS. 5A to 5H.

First, a plurality of the heating elements 201 are formed on the first face 102 of the substrate 101 made of silicon by forming a tantalum silicon nitride (TaSiN) resistance layer and an aluminum (Al) electrode. Further, the drive circuit portion 204 and the connection terminal 207 are formed by using a semiconductor manufacturing technique. The drive circuit portion 204 includes a plurality of drive circuits used for driving the heating element 201. The connection terminal 207 is electrically connected to an external device. Then, the protecting layer 208 that protects the heating element 201 from ink or the like is formed on the heating element 201. After then, the discharge port member 304 whose main component is resin such as epoxy resin is formed on the protecting layer 208 according to the photolithography technique. The discharge port member 304 includes the discharge port 301 which discharges liquid and the flow path 302 which communicates with the discharge port 301. According to the processes described above, the substrate 101 illustrated in FIG. 5A is formed.

Figure 5A:
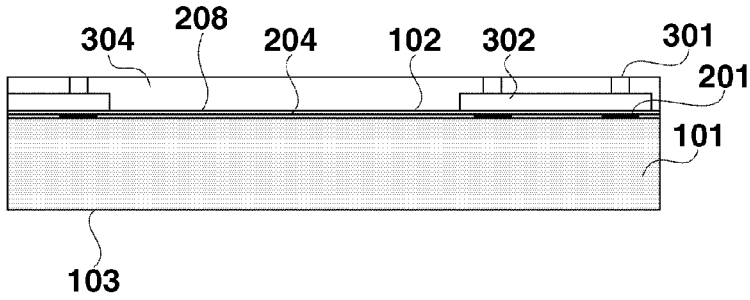
FIGS. 5A to 5H illustrate an example of a cross-sectional view of the head substrate for describing a manufacturing method of the head substrate.
Figure 5B:
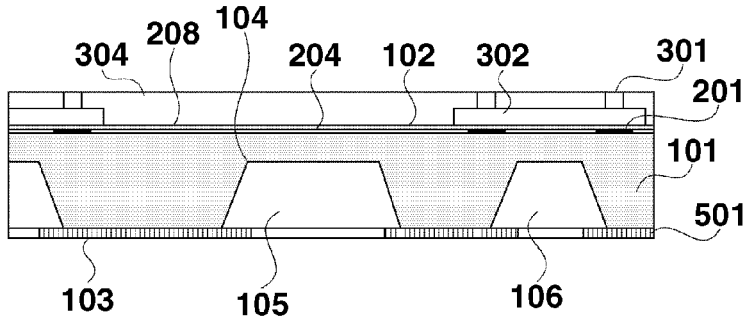

Next, as illustrated in FIG. 5B, the entire surface of the first face 102 and the second face 103 which is the other side of the first face 102 of the substrate 101 is coated with photoresist by spin coating or the like. Then, the photoresist is exposed and developed using the photolithography technique and a mask 501 is formed. The mask 501 defines an opening region of the second face 103 of the substrate 101. The opening region is etched (crystal anisotropic etching) with a strong alkali solution such as tetramethyl ammonium hydroxide (TMAH) or potassium hydroxide (KOH). Since the etching rate of a silicon substrate having crystal orientation of <111> is low, if a strong alkali is used as an etchant, the substrate 101 is etched with an angle of approximately 54.7 degrees with respect to the second face 103 of the substrate 101.

At that time, the mask 501 is formed such that a recessed portion that forms the first recessed portion 105 and a second recessed portion 106 which is used as the first supply port portion that configures a portion of the supply port are opened. According to this mask 501, the first recessed portion 105 and the second recessed portion 106 can be formed at a time. After the first recessed portion 105 and the second recessed portion 106 are simultaneously etched and formed so that the depth of the portions matches the third face 104 which shows the desired depth from the second face 103, the substrate 101 is immersed in a photoresist stripping agent or a mask etching liquid so that the mask 501 is removed. According to the above-described processing, the first recessed portion 105 and the second recessed portion 106 having a slope from the second face 103 to the third face 104 of the substrate 101 are formed.

Figure 5C:
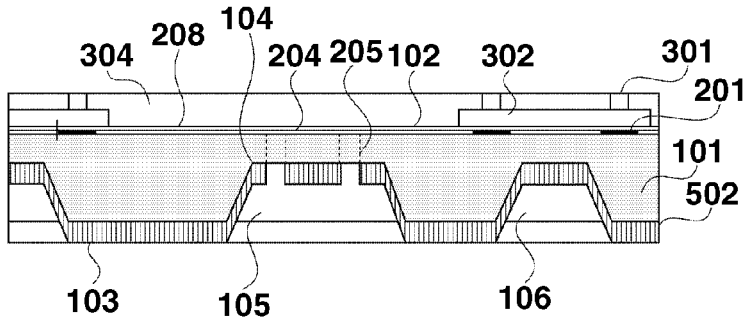
Figure 5D:
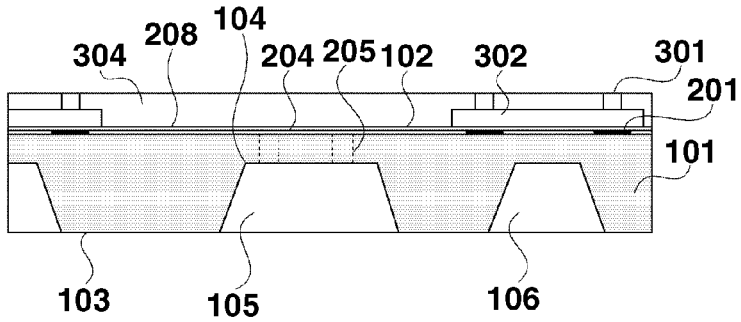

Next, as illustrated in FIG. 5C, the entire surface of the second face 103 of the substrate is coated with photoresist according to spin coating, slit coating, spray coating, or the like. Then the photoresist is exposed to light and developed using the photolithography technique. According to this process, a mask 502 used in the dry etching to define an opening position is formed. After then, a through hole of the through-hole electrode 205 is formed in the region between the first face 102 and the third face 104 of the substrate 101 by deep reactive-ion etching (RIE) such as the Bosch process. Subsequently, the mask 502 is immersed in a photoresist stripping agent or a mask etching liquid so that the photoresist is removed (see FIG. 5D).

Next, an insulating layer for securing insulation of the through-hole electrode 205 from the substrate 101 is formed on the entire surface. The insulating layer is formed by chemical vapor deposition (CVD) using silicon oxide, silicon nitride, and a resin such as parylene. After then, a mask is formed at the region where the through hole has been formed by the photolithography technique. Subsequently, according to etching of the insulating layer using, for example, RIE, the unnecessary insulating layer is removed.

Additionally, by coating the through hole with a metal film using, for example, vapor deposition, and by patterning the metal film using the photolithography technique, the through-hole electrode 205 which electrically connects the third face 104 and the first face 102 is formed. If a low resistance through-hole electrode is necessary, the inside of the through hole can be filled with a conductive material using electrolytic plating after the metal film is formed by vapor deposition.

Next, a metal film with high melting point such as titanium tungsten is formed on the entire face of the second face 103 as a diffusion preventing layer 503. Next, a conductive layer 504 for plating having superior performance as a wiring layer is formed on the entire surface using vacuum film formation. According to the present embodiment, gold is used as the conductive metal. In order to achieve good adhesion between the diffusion preventing layer and the conductive layer for plating, it is desirable to remove the oxide film of the diffusion preventing film before the conductive layer 504 for plating goes through the vapor deposition process. After the oxide film is removed, the conductive metal layer for plating is formed.

Figure 5E:
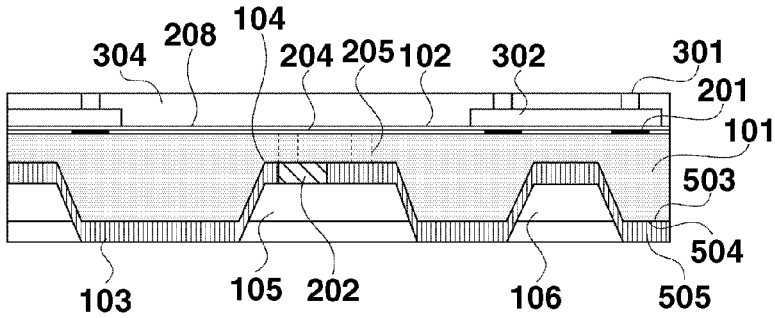

Subsequently, as illustrated in FIG. 5E, the entire surface of the gold layer as the conductive material for plating is coated with photoresist by spin coating, slit coating, spray coating, or the like. At this time, the photoresist is coated such that it is thicker than the desired wiring thickness. For example, if the desirable plating thickness is 15 μm, the photoresist will be coated such that its thickness is 20 μm.

Next, the substrate 101 goes through the photoresist exposure/development processing using photolithography. The gold layer as the conductive material for plating of the portion to be wired is exposed and a mask 505 is formed.

Next, according to electrolytic plating, the substrate 101 is immersed in an electrolytic bath of gold sulphite. When a voltage is applied to the gold layer of the conductive material for plating, gold in the region that is not covered with the mask 505 is deposited. Accordingly, the electrode layer 202 and the electrode layer 203 which are connected to a plurality of the through-hole electrodes 205 are formed. If a different thickness is required for the electrode layer 202 and the electrode layer 203, it can be obtained by repeating the resist process and the gold plating process.

After the electrode layer 203 and the electrode layer 202 are formed according to the above-described processes, the substrate 101 is immersed in a photoresist stripping agent to remove the photoresist.

Figure 5F:
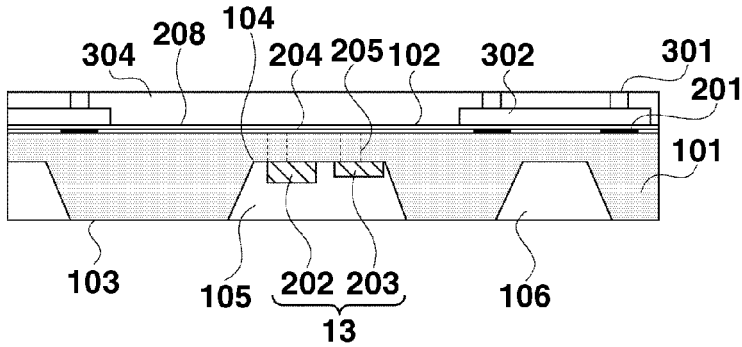

After then, the substrate 101 is immersed in an etchant including nitrogen organic compound, iodine, and potassium iodide. According to this process, the diffusion preventing layer 503 is exposed since the surface layer of the electrode layers 202 and 203 as well as the conductive layer 504 for plating are removed. Next, the diffusion preventing layer 503 is removed by immersing the substrate 101 in a hydrogen peroxide etchant. At this time, the electrode layers 202 and 203 serve as a mask. According to the processes above, the electrode layers 202 and 203 are formed on the third face 104 of the substrate 101 as illustrated in FIG. 5F.

Figure 5G:
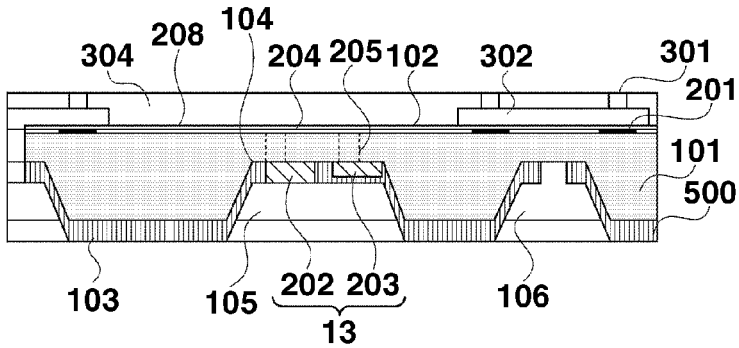

Next, as illustrated in FIG. 5G, the entire surface of the second face 103 is coated with photoresist by spin coating, slit coating, spray coating, or the like. Then, an opening of a through hole portion 109 which is to be the second supply port portion as a portion of the supply port 303 is formed. The opening is formed by patterning a mask 506. The patterning is performed by exposure and development of photoresist using photolithography.

Figure 5H:
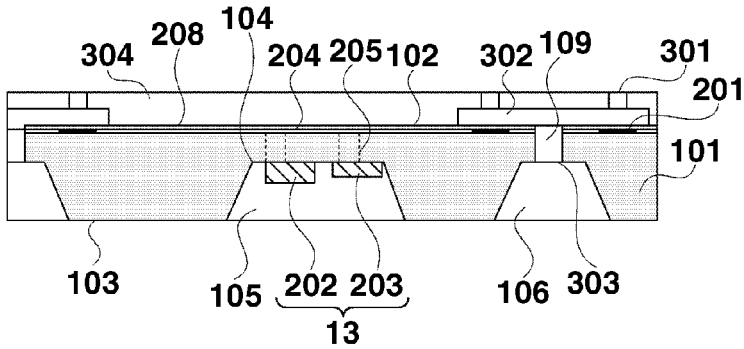

Next, as illustrated in FIG. 5H, the through hole portion 109 is formed by etching the third face 104 of the substrate 101 by deep RIE such as the Bosch process. The through hole portion 109 is used as the second supply port portion that penetrates the third face 104 and the first face 102 of the substrate 101. According to the above-described processes, the supply port 303 for supplying ink and including the second recessed portion 106 and the through hole portion 109 is formed.

Figure 6:
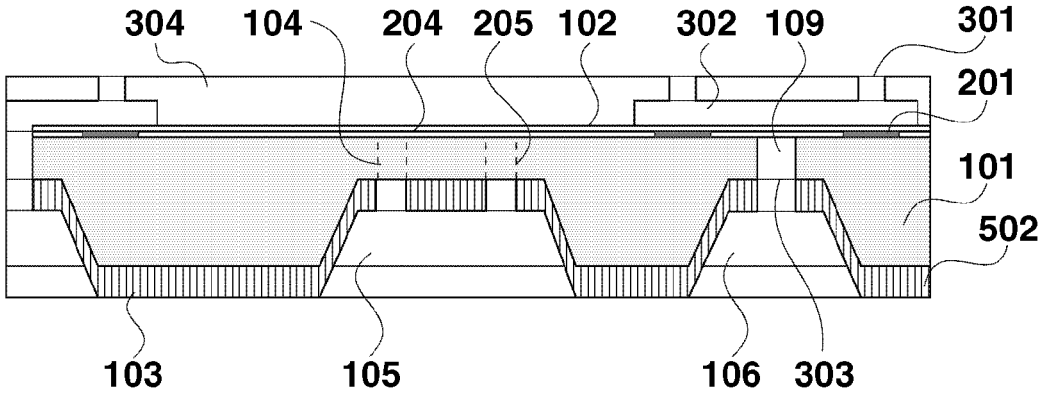
FIG. 6 is a cross-sectional view of the head substrate for describing a manufacturing method of the head substrate.

The opening area of the second recessed portion 106 is larger compared to the opening area of the through hole portion 109 so as to ensure the supply of ink. Since the etching speed of the through hole of the through-hole electrode 205 and the etching speed of the through hole portion 109 of the supply port 303 may be different, they are etched by different processes appropriate for their etching conditions. However, as illustrated in FIG. 6, the through hole of the through-hole electrode 205 and the through hole portion 109 of the supply port 303 can be collectively formed at desired positions in a single process by patterning the mask 502 and by dry etching the through hole of the through-hole electrode 205 and the through hole portion 109. By etching the through hole of the through-hole electrode 205 and the through hole portion 109 of the supply port 303 at the same time, the number of the necessary processes can be reduced. This contributes to reducing the manufacturing cost of the head substrate.

Since a plurality of the liquid discharge head substrates manufactured according to the above-described processes are simultaneously formed on a wafer, a plurality of the liquid discharge head substrates can be obtained by sectioning the wafer.

The liquid discharge head is formed by bonding the liquid discharge head substrate to the support substrate 401. An example of the manufacturing process of the support substrate 401 will be described below.

As illustrated in FIG. 4B, the member 402 made of a resin is provided such that it contacts the third face 104, and the slope between the second face 103 and the third face 104. The slope is formed by anisotropic etching of the first recessed portion 105. Further, the member 402 is provided such that both the face of the member 402 in the first recessed portion 105 and the second face 103 of the substrate 101 are level. The head substrate is mounted by bonding the mount face opposite to the face in which the discharge port 301 is provided, and the bonding face of the support substrate 401.

The mount face of the head substrate and the bonding face of the support substrate 401 are bonded by a resin same as the resin of the member 402 used for the first recessed portion 105. Although a bonding member other than the resin of the member 402 can be used, if a same material is used in the bonding, the number of the processes can be reduced, and good adhesion between the face of the first recessed portion 105 and the support substrate 401 can be obtained.

By sealing the first recessed portion 105 of the substrate 101 by the member 402 made of resin, and further, by bonding the second face 103 and the support substrate 401, a long distance between the supply port 303 and the electrode layer 202 as well as a long distance between the supply port 303 and the electrode layer 203 can be obtained. This is because a slope is formed between the supply port and the electrodes. As a result, the corrosion of the electrode layer that may occur when the ink seeps through the interface between the support substrate 401 and the substrate 101 can be prevented. Accordingly, a head substrate with enhanced reliability can be realized.

Figure 7A:
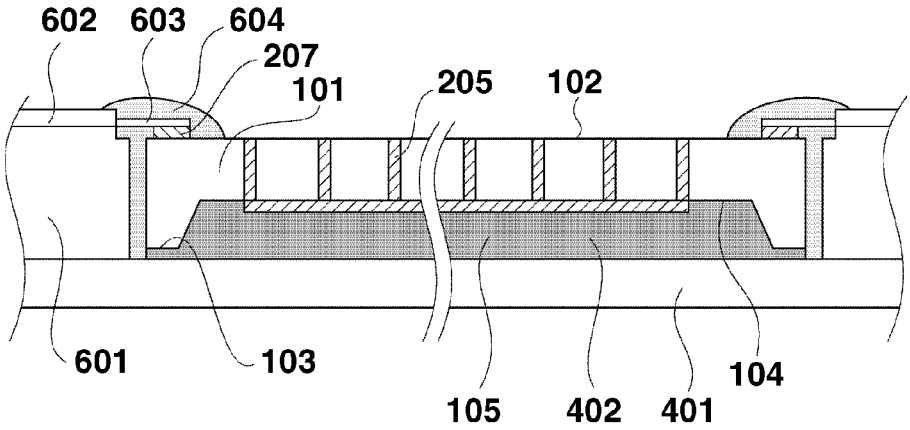
FIGS. 7A and 7B illustrate an example of a cross-sectional view of the head substrate illustrated in FIG. 3 taken along the line B-B'.

FIG. 7A illustrates an example of a schematic cross section of the head substrate illustrated in FIG. 3A taken along a line B-B'. Components such as the discharge port member 304 are omitted from FIG. 7A. The electrode layer 202 and the electrode layer 203 provided in the first recessed portion 105 are electrically connected to a plurality of the through-hole electrodes 205 connected to the individual power wiring 206 provided for each of the heating elements 201, and are in parallel with the row of the elements including the heating elements 201. Further, the first recessed portion 105 is filled with the resin member 402 so that the second face 103 of the substrate 101 and the face of the first recessed portion 105 are level. Further, the second face 103 which is on the opposite side of the face on which the discharge port 301 is provided is bonded to the connection face of the support substrate 401. The second face 103 and the connection face of the support substrate 401 are bonded using the resin used for the member 402 which is filled in the first recessed portion 105.

The connection terminal 207 is connected to a connection portion 603 of an electric wiring substrate 602 provided on a support plate 601 via the through-hole electrode 205 positioned at the end of the row of the through-hole electrodes, and is electrically connected to an external device. The connection terminal 207 is connected to the connection portion on the first face 102 of the substrate 101. The connection portion 603 is sealed with a sealing compound 604 so that ink does seep through the connection portion. Since the connection portion of the through-hole electrode 205 and the connection terminal 207 is provided on the side of the first face 102, the second face 103 of the substrate 101 bonded to the support substrate 401 can be flat.

As described above, since a plurality of the through-hole electrodes 205 that penetrate the substrate 101 are connected to the electrode layers 202 and 203 provided in the region between the second face and the third face of the substrate 101, and the member 402 which is a resin is provided in the first recessed portion 105, a flat second face of the substrate 101 can be obtained. Further, since the first recessed portion 105 is sealed with the member 402 being a resin, and the second face 103 and the support substrate 401 are bonded, the distance from the row of the supply ports to the electrode layer 202 as well as the electrode layer 203 can be increased without increasing the area of the substrate. Accordingly, the corrosion of the electrode layer that occurs due to the ink that seeps through the interface of the support substrate 401 and the substrate 101 can be prevented, and the area of the substrate can be reduced.

Figure 7B:
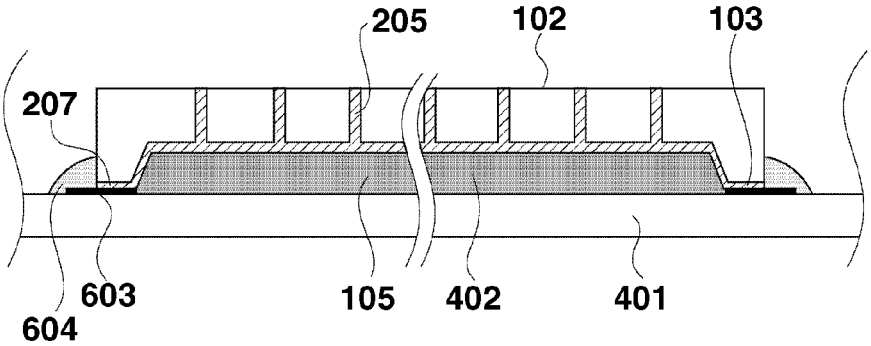

Further, as illustrated in FIG. 7B, the electrode layer 202 can be electrically connected to the connection terminal 207 provided on the second face 103 as illustrated in FIG. 7B. The connection terminal 207 is electrically connected to an external device. The electrode layers 202 and 203, which are electrically connected to the through-hole electrodes 205 and provided on the third face 104, are wired to the second face 103 and connected to the connection terminal 207. Further, the connection terminal 207 is electrically connected to the connection portion 603 provided on the support substrate 401, and thus electrically connected to an external device. The connection portion is sealed with the sealing compound 604 so that the connection portion is prevented from ink seepage. By providing the connection terminal 207 on the second face 103, the area for the connection terminal 207 on the first face 102 will be unnecessary, and the area of the substrate can be reduced. By reducing the area of the substrate, the number of the head substrates taken from one silicon substrate can be increased, and the manufacturing cost can be reduced.

According to the configuration described above, a small-size liquid discharge head substrate capable of preventing ink seepage to the electric connection portion can be obtained.

Further, by electrically connecting the through-hole electrodes 205, which penetrate the substrate 101, and the electrode layers 202 and 203 provided in the region between the second face and the third face of the substrate, the flatness of the second face of the substrate 101 can be maintained. Accordingly, a highly reliable head substrate whose bonding face of the support substrate 401 and the mounting face of the head substrate are parallel to each other and is capable of controlling the direction of the ink discharged from the discharge port can be obtained.

Next, an example of a liquid discharge head using the support substrate 401 according to a second exemplary embodiment will be described. The liquid discharge head substrate 82 is formed by a manufacturing method similar to the method used in the first exemplary embodiment.

Figure 8A:
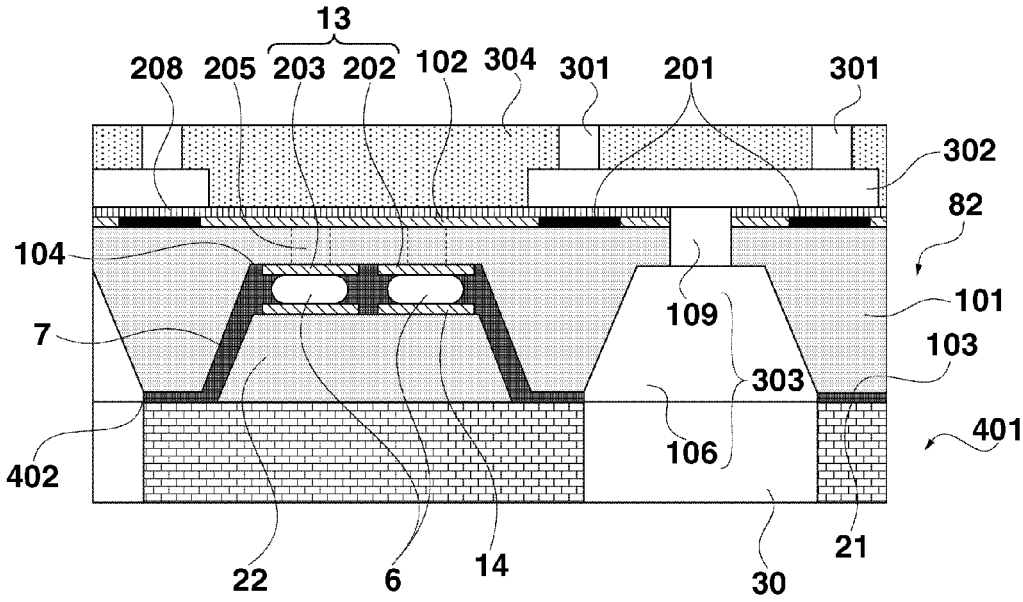
FIGS. 8A and 8B illustrate an example of a cross-sectional view of the head substrate illustrated in FIG. 3 taken along the lines A-A' and C-C'.
Figure 8B:
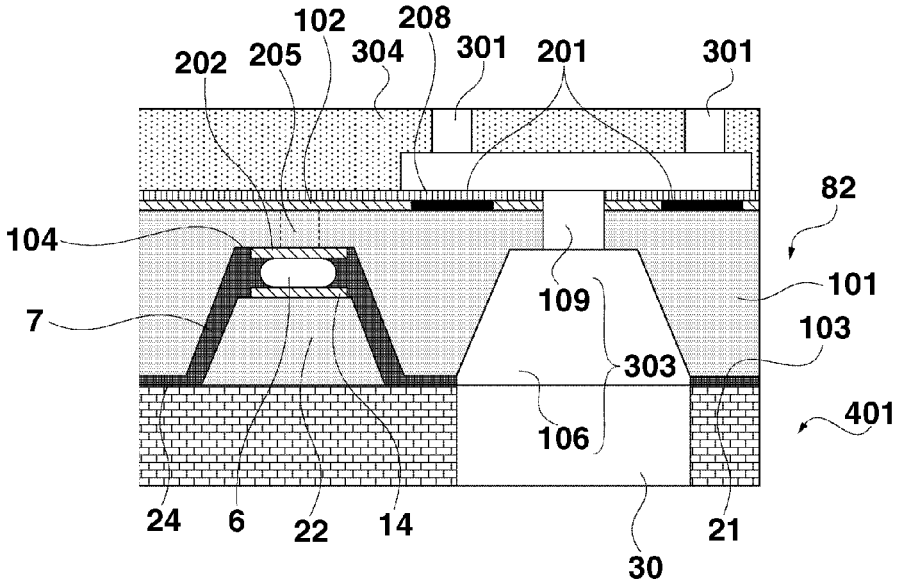

FIG. 8A illustrates an example of a schematic cross section of the head substrate illustrated in FIG. 3A taken along a line A-A'. The head substrate includes a plurality of rows of the supply ports. A power wiring 13 is provided in the region between adjacent rows of the supply ports. The power wiring 13 includes the electrode layers 202 and 203 which are connected to the heating element 201. FIG. 8B illustrates an example of a schematic cross section of the liquid discharge head including one row of the supply ports taken along a line C-C' illustrated in FIG. 3B.

The row of the supply ports including the supply ports 303 that supply ink to the heating element 201 includes the through hole portion 109 and the second recessed portion 106 of the row of the supply ports provided on the second face 103 opposing the first face 102 of the substrate where the heating element 201 is provided. The ink supplied from the opening 30 of the support substrate to the discharge port 301 via the supply port 303 is discharged from the discharge port 301 onto the recording medium by the energy generated from the heating element 201. The flow path 302 that connects the discharge port 301 and the discharge ports are formed by the discharge port member 304 made of resin. The protecting layer 208, which protects the heating element 201 from ink, is provided on the heating element 201. Further, the discharge port member 304 is provided on the protecting layer 208.

The individual power wiring 206 is connected to the heating element 201 and supplies current to the heating element 201. The individual power wiring 206 is also connected to the power wiring 13 in the first recessed portion 105 formed on the second face 103 of the substrate 101 via the through-hole electrode 205. The power wiring 13 is used for common GNDH wiring and VH wiring. Further, the power wiring 13 is provided along the row of the elements. One power wiring 13 is connected to either the GNDH wiring or the VH wiring. If both the GNDH wiring and the VH wiring are provided in the first recessed portion 105, two pieces of power wiring 13 will be provided.

The third face 104 is provided in the first recessed portion 105. The distance between the first face 102 and the second face 103 is greater than the distance between the first face 102 and the third face 104. The power wiring 13 is provided on a projected portion 22 via a bump 6 used as a connection member. The projected portion 22 projects beyond a mount face 21 of the support substrate 401. Further, the power wiring 13 is electrically connected to an electric connection terminal 14. The portion between the projected portion 22 and the first recessed portion 105 is sealed with the member 402 made of a resin material. The bump 6, the electric connection terminal 14, and the power wiring 13 are provided in that portion. In other words, the portion between the projected portion 22 and the first recessed portion 105 is sealed with the member 402 such that the bump 6, the electric connection terminal 14, and the power wiring 13 are covered with the member 402.

Figure 9A:
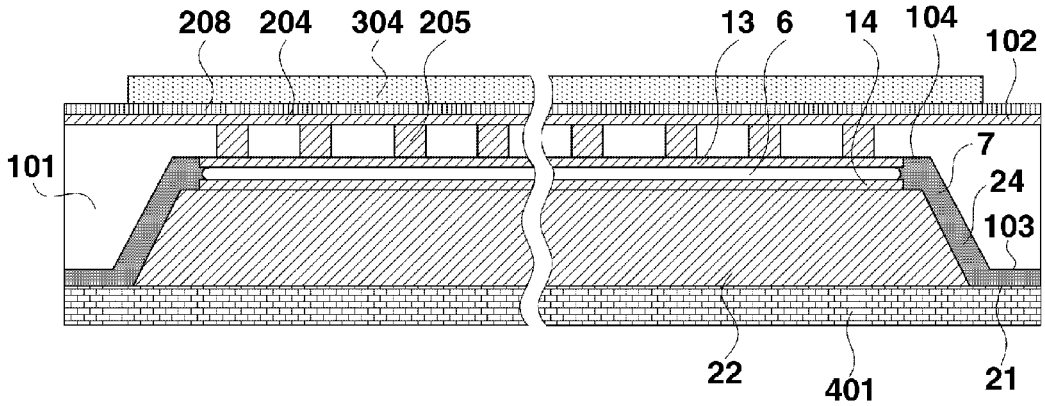
FIGS. 9A and 9B illustrate an example of a cross-sectional view of the head substrate illustrated in FIG. 3 taken along the B-B'.

FIG. 9A illustrates an example of a schematic cross section of the liquid discharge head illustrated in FIG. 3A taken along a line B-B'. A plurality of the through-hole electrodes 205, which are connected to the individual power wiring 206 provided for each of the plurality of the heating elements 201, are provided in the direction of the row of the elements. The through-hole electrodes 205 are connected to the power wiring 13 in the first recessed portion 105 of the substrate 101.

Figure 9B:
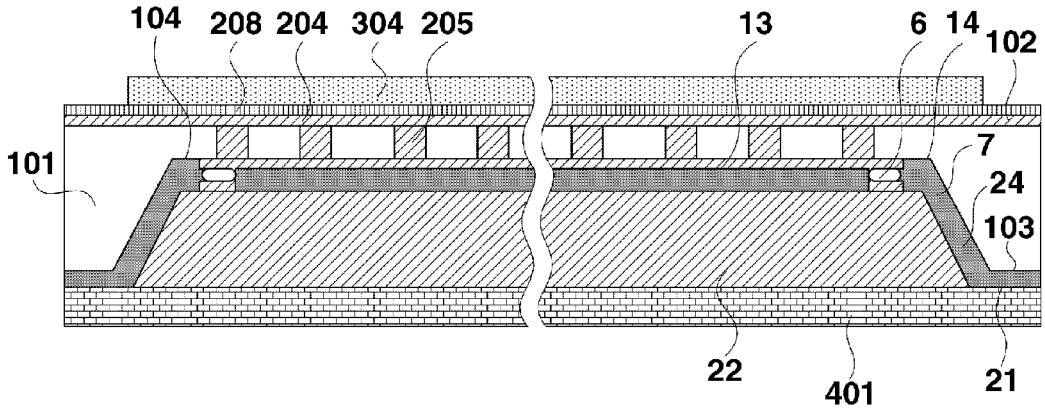

In FIG. 9A, the bumps 6 are provided on all the face of the power wiring 13 and the face of the electric connection terminal 14. However, only two bumps 6 are necessary as illustrated in FIG. 9B if electric connection is possible. The recessed portion of the substrate 101 and the projected portion of the support substrate 401 are electrically connected via the bumps 6. The bumps 6 are covered and sealed with the member 402 which is a resin such as an amine curable epoxy resin. The member 402 may be made of not only one type of material but a plurality of materials may be used in the sealing. Further, an adhesive material can be used as the member 402.

As described above, the recessed portion of the substrate 101 and the projected portion of the support substrate 401 are electrically connected, and the gap between the recessed portion and the projected portion is sealed. According to this configuration, even if the size of the head substrate is furthermore reduced, a distance that can prevent ink seepage to the bump is provided between the bump 6 and the supply port 303.

Figure 10A:
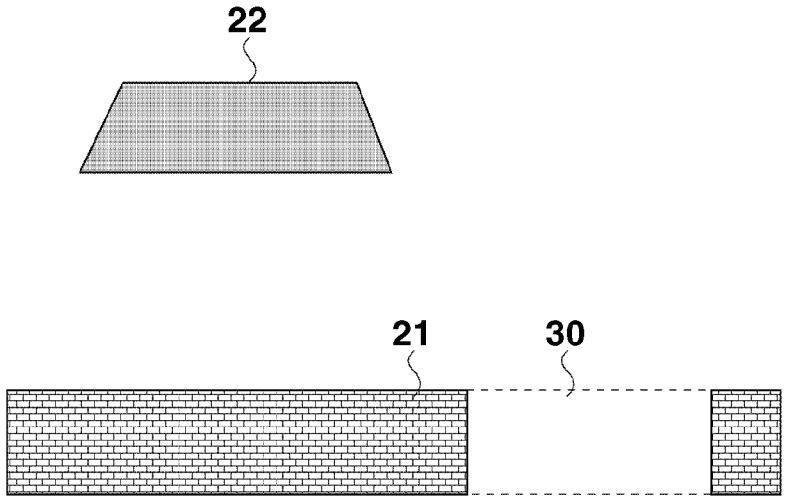
FIGS. 10A to 10C illustrate an example of a cross-sectional view for describing a manufacturing method of the support substrate.

Next, the manufacturing method of the support substrate bonded to the liquid discharge head substrate will be described with reference to FIGS. 10A-10C.

First, a photoresist mask with an opening width of approximately 900 μm is formed on a silicon substrate (a third substrate) whose thickness is thinner than the depth of the first recessed portion. Next, as is with the first substrate, using strong alkali such as TMAH as an etchant, the portion other than the portion to be used as the projected portion member is removed by crystal anisotropic etching. By using a silicon substrate having crystal orientation of <100>, a projected portion having a second slope with a slope angle of approximately 54.7 degrees with respect to the face of the substrate, which is the same slope angle with respect to the first slope, can be formed on the face of the third substrate (see FIG. 10A).

Figure 10B:
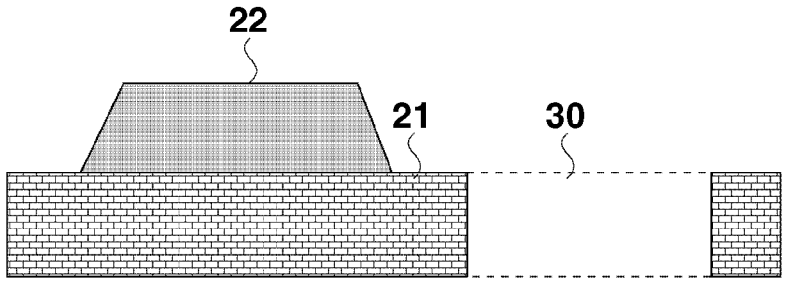
Figure 10C:
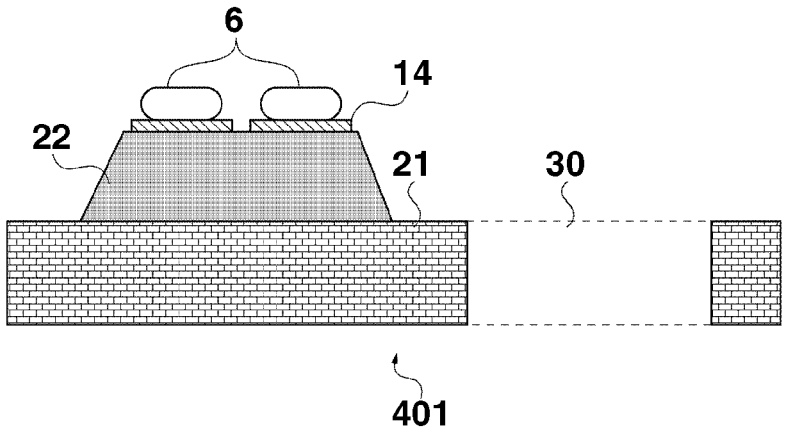

Further, by bonding the projected portion member to the mount face 21 of the substrate (second substrate) made of alumina and including the opening 30 used for supplying ink, the support substrate 401 having the projected portion 22 illustrated in FIG. 10B is obtained. Further, the bump 6, which is formed by a conductive material such as gold, and the electric connection terminal 14 are formed on the projected portion 22 of the support substrate 401 (see FIG. 10C).

Next, the projected portion 22 of the support substrate 401 having the second slope illustrated in FIG. 10B is fit into the first recessed portion 105 of the head substrate 82 including the first slope. The projected portion 22 is fit into the first recessed portion 105 such that the position of the opening 30 of the support substrate 401 matches the position of the supply port 303 of the head substrate 82. According to the above-described processing, the power wiring 13 of the head substrate 82 and the bump 6 of the support substrate 401 are electrically connected, and ink can be supplied from the opening 30 of the support substrate 401 to the supply port of the head substrate 82.

After then, the member 402 made of amine curable epoxy resin composition is filled in the gap between the first recessed portion 105, where the bump 6, the electric connection terminal 14, and the power wiring 13 are provided, and the projected portion 22 so that the components are covered with the resin. In this way, the gap is sealed as illustrated in FIG. 8A.

As described above, the first recessed portion 105 in the head substrate 82 and the projected portion 22 in the support substrate 401 are formed. Then, after the first recessed portion 105 and the projected portion 22 are electrically connected, the gap between the slopes of the first recessed portion 105 and the projected portion 22 is sealed by the member 402. In this way, a distance between the bump 6 and the supply ports 303, necessary in preventing the ink seepage to the bump 6, can be obtained even if the size of the head substrate is furthermore reduced.

Further, by filling the gap between the first slope of the first recessed portion 105 and the second slope of the projected portion 22, which is substantially parallel with the first slope, with the member 402 made of a resin material, the gap can be securely sealed. Thus, the corrosion which might occur due to ink can be prevented. Accordingly, a liquid discharge head which can prevent ink seepage to the bump 6 and the power wiring 13 can be realized even if the size of the head substrate is furthermore reduced.

Another manufacturing method of the support substrate of the liquid discharge head described in the second exemplary embodiment will be described as a third exemplary embodiment of the present invention. The head substrate used in the third exemplary embodiment is the same as the head substrate used in the first exemplary embodiment.

Figure 11A:
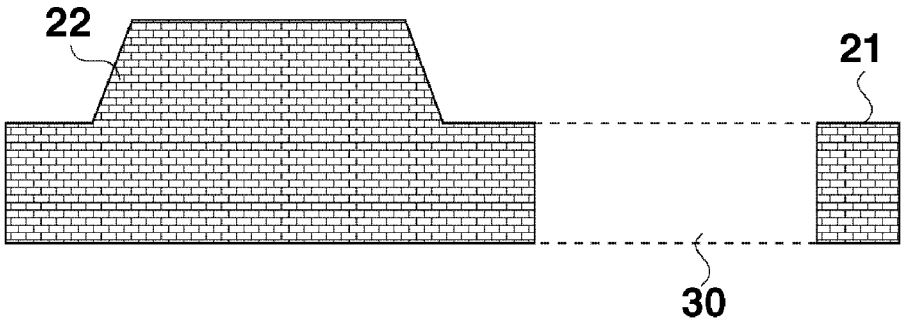
FIGS. 11A and 11B illustrate an example of a cross-sectional view for describing a manufacturing method of the support substrate.

The support substrate 401 is formed by injection molding using polysulfone resin having good heat/chemical resistance properties. The obtained support substrate 401 is 900 μm in the direction perpendicular to the row of the elements and includes the projected portion 22 whose height is 425 μm and the opening 30 which is used when ink is supplied (see FIG. 11A). The resin used for the support substrate 401 is not limited to the above-described resin and a resin which can be used in the injection molding and has good heat/chemical resistance properties can be also used. For example, polyether sulphone resin, polyphenylene ether resin, polyphenylene oxide resin, and polypropylene resin can be used for the support substrate 401. When the support substrate 401 is molded, the projected portion 22 is formed such that the slope angle of the second slope is same as the slope angle of the first recessed portion 105 of the head substrate.

Figure 11B:
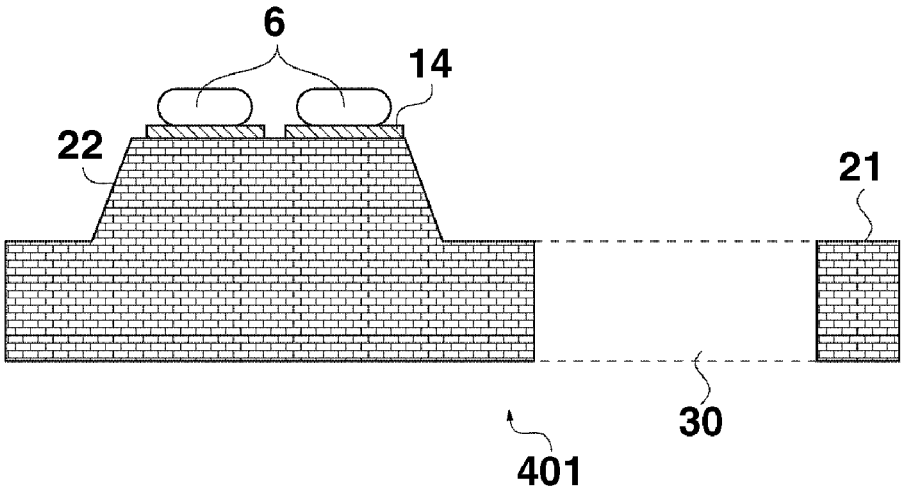

Next, the bump 6 made of a conductive material such as gold and the electric connection terminal 14 are formed on the projected portion 22 of the support substrate 401 (see FIG. 11B).

The head substrate 82 and the support substrate 401 illustrated in FIG. 11B are bonded and electrically connected. The substrates are bonded so that the position of the opening 30 of the support substrate 401 matches the position of the supply port 303 of the head substrate 82. According to this configuration, ink can be supplied from the support substrate 401 to the head substrate 82.

Further, the member 402, which is an amine curable epoxy resin composition, is filled in a gap of approximately 50 μm between the projected portion 22 and the first recessed portion 105 where the bump 6, the electric connection terminal 14, and the power wiring 13 are provided. Accordingly, the gap is sealed as illustrated in FIG. 8A.

As described above, the first recessed portion 105 provided in the head substrate 82 and the projected portion 22 provided in the support substrate 401 are bonded and electrically connected. Further, the gap between the slopes of the first recessed portion and the projected portion is sealed with the member 402. According to this configuration, a distance between the bump 6 and the supply ports 303 necessary in preventing the ink seepage to the bump 6 can be obtained even if the size of the head substrate is furthermore reduced.

Further, the support substrate 401 is formed with a resin member using injection molding so that the slope angle of its slope is similar to the slope angle of the first recessed portion 105. A gap between the first slope of the first recessed portion 105 and the second slope of the projected portion 22, which is substantially parallel to the first slope, is sealed with the member 402 made of resin. Accordingly, the bump 6 and the power wiring 13 can be covered and sealed. Thus, a liquid discharge head which can prevent ink seepage can be realized even if the size of the head substrate is furthermore reduced.

Further, by using the injection molding technique described in the present exemplary embodiment, the etching process of the projected portion and the bonding process of the alumina substrate described in the second exemplary embodiment will become unnecessary, and the manufacturing cost can be reduced.

Although the discharge head described in the above-described embodiments is a liquid discharge head which can be applied to a recording apparatus using the ink jet recording method, the liquid discharge head according to the present invention can also be applied to an apparatus employing a method that discharges a droplet using vibration energy generated by a piezoelectric element.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2009-168986 filed Jul. 17, 2009 and No. 2009-209540 filed Sep. 10, 2009, which are hereby incorporated by reference herein in their entirety.

What is claimed is:

1. A liquid discharge head substrate comprising:

a base including:

a first face having a plurality of elements configured to generate energy used for discharging a liquid;

a second face which is on the other side of the first face and includes a recessed portion; and a supply port for supplying the liquid and penetrating between the first face and the second face;

a plurality of electrodes each of which is electrically connected to each of the plurality of the elements, and penetrates the base from the first face to an inner side of the recessed portion;

an electrode layer commonly and electrically connected to the plurality of electrodes and provided in the inner side; and a resin member provided in the recessed portion to cover the electrode layer.

2. The liquid discharge head substrate according to claim 1, wherein the base includes a plurality of the supply ports which are arrayed to be a supply port row.

3. The liquid discharge head substrate according to claim 2, wherein an element row made of the plurality of the arrayed elements is provided on both sides of the supply port row.

4. The liquid discharge head substrate according to claim 2, wherein a plurality of the supply port rows are provided, and in a region between a first supply port row and a second supply port row, which are adjacent to each other, an element corresponding to a first element row in the first supply port row and an element corresponding to a second element row in the second supply port row are commonly and electrically connected to the electrode layer.

5. The liquid discharge head substrate according to claim 1, wherein the base includes a slope which is contiguous to the second face and formed in a slanting direction from the second face up to a position between the first face and the second face, and wherein the resin member contacts the slope.

6. The liquid discharge head substrate according to claim 1, wherein a connection terminal which can be electrically connected to a connection terminal for supplying power to the liquid discharge head substrate is provided on the second face.

7. A liquid discharge head comprising:

the liquid discharge head substrate according to claim 1; and a support base configured to support the liquid discharge head substrate, wherein the second face of the liquid discharge head substrate and the support base are bonded together.

8. A liquid discharge head comprising:

the liquid discharge head substrate according to claim 1;

a support base which supports the liquid discharge head substrate from a side of the second face, and includes a projected portion provided in an inner side of the recessed portion, a connection member electrically connected to the electrode layer provided on the projected portion, and an opening which communicates with the supply port and is configured to supply a liquid to the supply port, wherein the resin member is provided between the support base and the liquid discharge head substrate from the inner side of the recessed portion to the second face such that the resin member covers the electrode layer and the connection member.

9. The liquid discharge head according to claim 8, wherein the recessed portion includes a first slope contiguous with the second face and extends from the second face to a position between the first face and the second face, and wherein the projected portion includes a second slope substantially parallel to the first slope and wherein the resin member is provided between the first slope and the second slope.

* * * * *